US011024230B2

(12) United States Patent
Liu et al.

(10) Patent No.: US 11,024,230 B2
(45) Date of Patent: Jun. 1, 2021

(54) DISPLAY SCREEN, DISPLAY DEVICE, DISPLAY CIRCUIT AND BRIGHTNESS COMPENSATION METHOD THEREFOR

(71) Applicant: BOE TECHNOLOGY GROUP CO., LTD., Beijing (CN)

(72) Inventors: Libin Liu, Beijing (CN); Yu Feng, Beijing (CN); Ming Che Hsieh, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/619,296

(22) PCT Filed: Dec. 4, 2018

(86) PCT No.: PCT/CN2018/119117
§ 371 (c)(1),
(2) Date: Dec. 4, 2019

(87) PCT Pub. No.: WO2019/109903
PCT Pub. Date: Jun. 13, 2019

(65) Prior Publication Data

US 2020/0098318 A1 Mar. 26, 2020

(30) Foreign Application Priority Data

Dec. 5, 2017 (CN) ..... 201711270046.5

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/0465* (2013.01); *G09G 2300/0847* (2013.01)

(58) Field of Classification Search
CPC ..... G09G 3/3258; G09G 3/3291; G09G 2300/0465; G09G 2300/0847;
(Continued)

(56) References Cited

U.S. PATENT DOCUMENTS 10,403,200 B2 * 9/2019 Xu ..... H01L 27/326
2005/0242744 A1 11/2005 Tseng
(Continued)

FOREIGN PATENT DOCUMENTS

CN 1571005 A 1/2005
CN 1764829 A 4/2006
(Continued)

OTHER PUBLICATIONS

First Office Action dated Apr. 14, 2020 by the Chinese Patent Office in the priority Chinese application No. 201711270046.5 and its English translation.

*Primary Examiner* — Abhishek Sarma
(74) *Attorney, Agent, or Firm* — Dilworth & Barrese, Esq.; Michael J. Musella, Esq.

(57) ABSTRACT

A display screen, a display device, a display circuit used for the display screen and a brightness compensation method therefor. The display screen (10) includes a normal display area (11) and a transparent display area (12). The display circuit (20) includes: a first pixel circuit (21), wherein the first pixel circuit is arranged at the normal display area; and a second pixel circuit (22), wherein the second pixel circuit is arranged at the transparent display area. The structure of the first pixel circuit is different from that of the second pixel circuit, so that the light transmittance of the transparent display area is higher than the light transmittance of the normal display area.

19 Claims, 5 Drawing Sheets

(58) Field of Classification Search
CPC ... G09G 2300/0819; G09G 2300/0861; G09G 2300/0842; G09G 3/3233; G09G 2320/0233; G09G 2300/0452; G09G 2320/0686
See application file for complete search history.

(56) References Cited

U.S. PATENT DOCUMENTS

| | | | |
|---|---|---|---|
| 2009/0309859 | A1 | 12/2009 | Nishi et al. |
| 2015/0271392 | A1 | 9/2015 | Musgrave et al. |
| 2017/0178566 | A1 | 6/2017 | Xu et al. |
| 2017/0309226 | A1 | 10/2017 | In et al. |

FOREIGN PATENT DOCUMENTS

| | | | |
|---|---|---|---|
| CN | 203882588 | U | 10/2014 |
| CN | 105047687 | A | 11/2015 |
| CN | 106409232 | A | 2/2017 |
| CN | 106920470 | A | 7/2017 |
| CN | 107316605 | A | 11/2017 |
| CN | 107340660 | A | 11/2017 |
| JP | 2004056297 | A | 2/2004 |

* cited by examiner

DISPLAY SCREEN, DISPLAY DEVICE, DISPLAY CIRCUIT AND BRIGHTNESS COMPENSATION METHOD THEREFOR

TECHNICAL FIELD

The present disclosure relates to the field of display technologies, and in particular, to a display circuit for a display screen, a display screen, a display device, and a luminance compensation method for a display circuit for a display screen.

BACKGROUND

At present, the Screen-to-Body Ratio of mobile terminals such as mobile phones and tablet computers is getting higher and higher. Generally, the way to achieve higher Screen-to-Body Ratio is mainly to reduce the border of the mobile terminal. For example, the original home button at the bottom of the mobile phone is removed, and the border at the position of the camera at the top of the mobile phone is reduced to reduce the border in the length direction, thereby effectively increasing the Screen-to-Body Ratio; for example, while reducing the border at the position of the camera at the top of the mobile phone, the display screen of the mobile phone is set to a curved screen to reduce the border in both the width direction and the length direction at the same time, thereby effectively increasing the Screen-to-Body Ratio.

Although the above two ways can make the Screen-to-Body Ratio reach a certain level to some extent, there is still a margin for further improvement.

SUMMARY

The present disclosure aims to solve at least one of the technical problems in the related art to some extent. To this end, a first object of the present disclosure is to provide a display circuit for a display screen, which effectively improves transmittance of a transparent display area of the display screen by disposing a pixel circuit at the transparent display area different from that at a normal display area of the display screen. Thus, an optical detector and a camera can be disposed at the transparent display area, thereby effectively increasing the Screen-to-Body Ratio without affecting the normal operation of the optical detector and the camera and the normal display function of the display screen.

A second object of the present disclosure is to propose a display screen.

A third object of the present disclosure is to propose a display device.

A fourth object of the present disclosure is to propose a luminance compensation method for a display circuit for a display screen.

In order to achieve the above objects, a first aspect of the present disclosure provides a display circuit for a display screen, the display screen including a normal display area and a transparent display area, the display circuit includes: a first pixel circuit, the first pixel circuit is disposed at the normal display area; a second pixel circuit, the second pixel circuit is disposed at the transparent display area; wherein, the structure of the first pixel circuit is different from that of the second pixel circuit, so that transmittance of the transparent display area is higher than transmittance of the normal display area.

In addition, the display circuit for a display screen according to the above-described embodiment of the present disclosure may further have the following additional technical features.

According to an embodiment of the present disclosure, the number of components of the second pixel circuit is less than the number of components of the first pixel circuit.

According to an embodiment of the present disclosure, the first pixel circuit comprises: a reset circuit, which is connected to a reset control line, a reset signal line, one end of a first storage capacitor, a control electrode of a first driving transistor, and one end of a first lighting device respectively, and is configured to reset said one end of the first storage capacitor and said one end of the first lighting device; a first data writing circuit, which is connected to a first data line, a first gate line and a first electrode of the first driving transistor respectively, and is configured to write a first data voltage into the first electrode of the first driving transistor; a compensation circuit, which is connected to a first gate line, the control electrode of the first driving transistor, and a second electrode of the first driving transistor respectively, and is configured to write the threshold voltage of the first driving transistor and the first data voltage into said one end of the first storage capacitor; a first lighting control circuit, which is connected to a first lighting control line, a first power line, the first electrode of the first driving transistor, a second electrode of the first driving transistor, said one end of the first lighting device respectively, the other end of the first lighting device is connected to a second power line, and the lighting control circuit is configured to write a first power voltage into the first electrode of the first driving transistor, and control the first driving transistor to drive the first lighting device to emit light.

According to an embodiment of the present disclosure, the reset circuit comprises: a first transistor, a control electrode of the first transistor is connected to a reset control line, a first electrode of the first transistor is connected to one end of the first storage capacitor and a control electrode of the first driving transistor respectively, the second electrode of the first transistor is connected to the reset signal line; and a second transistor, a control electrode of the second transistor is connected to the reset control line, a first electrode of the second transistor is connected to the reset signal line, and a second electrode of the second transistor is connected to one end of a first lighting device.

According to an embodiment of the present disclosure, the first data writing circuit comprises: a third transistor, a control electrode of the third transistor is connected to the first gate line, a first electrode of the third transistor is connected to the first data line, and a second electrode of the third transistor is connected to the first electrode of the first drive transistor.

According to an embodiment of the present disclosure, the compensation circuit comprises: a fourth transistor, a control electrode of the fourth transistor is connected to the first gate line, a first electrode of the fourth transistor is connected to a control electrode of the first driving transistor, and a second electrode of the fourth transistor is connected to a second electrode of the first driving transistor.

According to an embodiment of the present disclosure, the first lighting control circuit comprises: a fifth transistor, a control electrode of the fifth transistor is connected to the first lighting control line, a first electrode of the fifth transistor is connected to the first power line, and a second electrode of the fifth transistor is connected to a first electrode of the first driving transistor; a sixth transistor, a control electrode of the sixth transistor is connected to the first lighting control line, a first electrode of the sixth transistor is connected to a second electrode of the first driving transistor, and a second electrode of the sixth transistor is connected to one end of the first lighting device.

According to an embodiment of the present disclosure, the second pixel circuit comprises: a second data writing circuit, which is connected to the second data line, the second gate line, one end of the second storage capacitor, and the control electrode of the second driving transistor respectively, the other end of the second storage capacitor and the first electrode of the second driving transistor are respectively connected to the first power line, and the second data writing circuit is configured to write the second data voltage to one end of the second storage capacitor; a second lighting control circuit, which is connected to the second lighting control line, the second electrode of the second driving transistor, and one end of the second lighting device respectively, the other end of the second lighting device is connected to the second power line, and the second lighting control circuit is configured to control the second driving transistor to drive the second lighting device to emit light.

According to an embodiment of the present disclosure, the second data writing circuit comprises: a seventh transistor, a control electrode of the seventh transistor is connected to the second gate line, a first electrode of the seventh transistor is connected to the second data line, and a second electrode of the seventh transistor is one end of the second storage capacitor and a control electrode of the second driving transistor respectively.

According to an embodiment of the present disclosure, the second lighting control circuit comprises: an eighth transistor, a control electrode of the eighth transistor is connected to the second lighting control line, a first electrode of the eighth transistor is connected to a second electrode of the second driving transistor, and a second electrode of the eighth transistor is connected to one end of the second lighting device.

According to an embodiment of the present disclosure, the PPI of the transparent display area (Pixels Per Inch, the number of pixels per inch of the image) is smaller than the PPI of the normal display area.

According to an embodiment of the present disclosure, a pixel aperture ratio of the transparent display area is greater than a pixel aperture ratio of the normal display area.

According to an embodiment of the present disclosure, the display circuit for a display screen as described above further comprises: a first luminance adjustment circuit, which is connected to the first pixel circuit, and is configured to output a first data voltage to the first pixel circuit to adjust the luminance of the normal display area; and a second luminance adjustment circuit, which is connected to the second pixel circuit, and is configured to output a second data voltage to the second pixel circuit to adjust the luminance of the transparent display area.

According to an embodiment of the present disclosure, the display circuit for a display screen as described above further comprises: a luminance compensation circuit, which is connected to the first luminance adjustment circuit and the second luminance adjustment circuit respectively, and is configured to acquire the second data voltage according to the first data voltage and the threshold voltage of the second driving transistor in the second pixel circuit such that the luminance of the transparent display area is the same as the luminance of the normal display area.

According to an embodiment of the present disclosure, an aspect ratio of the first driving transistor in the first pixel circuit is greater than that of the second driving transistor in the second pixel circuit, such that the luminance of the transparent display area is the same as the luminance of the normal display area.

According to an embodiment of the present disclosure, the transparent display area is disposed at an edge of the normal display area.

To achieve the above objects, a second aspect of the present disclosure proposes a display screen including a normal display area, a transparent display area, and the above display circuit.

To achieve the above objects, a third aspect of the present disclosure provides a display device including the above display screen.

To achieve the above objects, a fourth aspect of the present disclosure provides a luminance compensation method for a display circuit for a display screen, comprising the steps of: acquiring a first data voltage of the first pixel circuit disposed at the normal display area, and acquiring a second threshold voltage of the second driving transistor in the second pixel circuit disposed at the transparent display area; acquiring a second data voltage of the second pixel circuit disposed at the transparent display area, according to the first data voltage and the threshold voltage of the second driving transistor; and adjusting the luminance of the transparent display area according to the second data voltage, such that the luminance of the transparent display area is the same as the luminance of the normal display area.

DETAILED DESCRIPTION OF THE EMBODIMENTS

Figure 1:
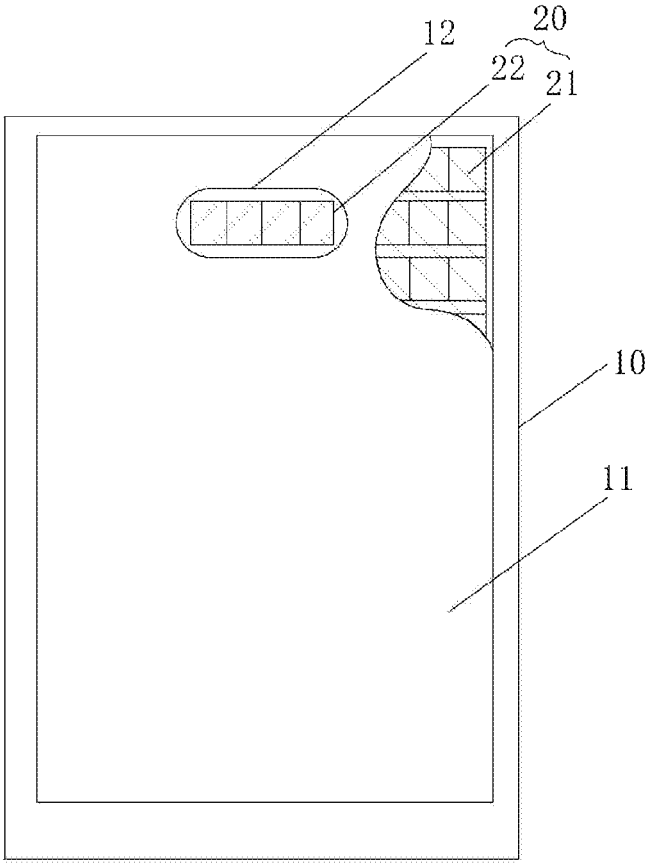
FIG. 1 is a schematic block diagram of a display circuit for a display screen in accordance with an embodiment of the present disclosure.

A display circuit for a display screen of according to an embodiment of the present disclosure is provided, a normal display area and a transparent display area are disposed on the display screen, and the display circuit includes a first pixel circuit and a second pixel circuit, wherein the first pixel circuit is disposed at the normal display area, and the second pixel circuit is disposed at the transparent display area, the structure of the first pixel circuit is different from that of the second pixel circuit, so that transmittance of the transparent display area is higher than transmittance of the normal display area. Thereby, transmittance of the transparent display area is effectively improved by disposing a pixel circuit at the transparent display area of the display screen different from that at the normal display area of the display screen, and an optical detector and a camera can be disposed at the transparent display area, thereby effectively increasing the Screen-to-Body Ratio without affecting the normal operation of the optical detector and the camera and the normal display function of the display screen.

According to the display screen of the embodiment of the present disclosure, by adopting the display circuit described above, transmittance of the transparent display area is effectively improved by disposing a pixel circuit at the transparent display area of the display screen different from that at the normal display area of the display screen, and an optical detector and a camera can be disposed at the transparent display area, thereby effectively increasing the Screen-to-Body Ratio without affecting the normal operation of the optical detector and the camera and the normal display function of the display screen.

According to the display device of the embodiment of the present disclosure, by adopting the display circuit described above, transmittance of the transparent display area is effectively improved by disposing a pixel circuit at the transparent display area of the display screen different from that at the normal display area of the display screen, and an optical detector and a camera can be disposed at the transparent display area, thereby effectively increasing the Screen-to-Body Ratio without affecting the normal operation of the optical detector and the camera and the normal display function of the display screen.

A luminance compensation method for a display circuit for a display screen according to an embodiment of the present disclosure acquires a first data voltage of a first pixel circuit disposed at a normal display area, and acquires a threshold voltage of a second driving transistor in a second pixel circuit disposed at the transparent display area, acquiring a second data voltage of the second pixel circuit disposed at the transparent display area according to the first data voltage and the threshold voltage of the second driving transistor, and adjusting luminance of the transparent display area according to the second data voltage so that the luminance of the transparent display area is the same as the luminance of the normal display area. Thereby, the luminance compensation is implemented by performing voltage compensation on the basis of the data voltage corresponding to the first pixel circuit, so that the luminance of the transparent display area is the same as the luminance of the normal display area. By doing so, the problems of the luminance reduction due to transmittance increasing of the transparent display area and the picture quality difference between the transparent display area and the normal display area led correspondingly can be effectively reduced. Further, the method is simple, reliable, easy to implement, and highly versatile.

The embodiments of the present disclosure are described in detail below, and the examples of the embodiments are illustrated in the drawings, wherein the same or similar reference numerals refer to the same or similar elements or the elements having the same or similar functions. The embodiments described below with reference to the drawings are illustrative, which are intended to explain the present disclosure and are not intended to be construed as limitation to the present disclosure.

A display circuit for a display screen, a display screen, and a luminance compensation method for a display circuit for a display screen according to embodiments of the present disclosure will be described below with reference to the accompanying drawings.

FIG. 1 is a schematic block diagram of a display circuit for a display screen in accordance with an embodiment of the present disclosure.

As shown in FIG. 1, the display screen 10 includes a normal display area 11 and a transparent display area 12, and the display circuit 20 includes a first pixel circuit 21 and a second pixel circuit 22. The normal display area 11 is an area that performs normal display as in the related art, and may be referred to as a first area; the transparent display area 12 has a transmittance higher than that of the normal display area 11, so that devices disposed behind the display screen, such as optical detectors and cameras, can capture light or images, and the transparent display area 12 can be referred to as a second area. The first pixel circuit 21 is disposed at the normal display area 11, and the second pixel circuit 22 is disposed at the transparent display area 12. The first pixel circuit 21 and the second pixel circuit 22 have different structures so that the transmittance of the transparent display area 12 is higher than that of the normal display area 11.

Specifically, at present, increasing the Screen-to-Body Ratio of the display screen is mainly achieved by gradually reducing the border area of the display screen, such as removing the original home button on the display screen, reducing the border at the positions of components such as an optical detector and a camera, or setting the display to a curved screen, to further increase the Screen-to-Body Ratio. Although these methods can make the Screen-to-Body Ratio of the display screen reach a certain level to some extent, there is still a margin for further improvement. For example, in the present disclosure, a transparent display area 12 is disposed in the original non-transparent display screen 10, and components such as an optical detector and a camera are disposed at the transparent display area 12, so that the Screen-to-Body Ratio of the display screen can be further increased.

In particular, a transparent display area 12 can be reserved in the current non-transparent display screen 10. In the embodiment of the present disclosure, the transparent display area 12 may be disposed at the edge of the normal display area 11, and may also be disposed in the middle of the normal display area 11. The specific position and size of the transparent display area 12 may be determined according to the positions and sizes of the components such as an optical detector and a camera to be disposed. According to current user usage habits, for example, it is disposed at the edge of the normal display area 11, that is, the edge of the display screen 10.

Since the optical detector and the camera are configured to collect light outside the display screen 10 and images and the like, it is desirable that the transmittance of the transparent display area 12 is as high as possible. However, it is conceivable that, since the components such as an optical detector and a camera can be disposed at any position behind the display screen 10, and if only the components such as an optical detector and a camera are disposed at the transparent display area 12, the picture display will be discontinuous. Thus, the pixel circuit will also be disposed at the transparent display area 12 so as to cooperate with the pixel circuit in the normal display area 11 to ensure the integrity of the picture display. However, if the pixel circuit at the transparent display area 12 is disposed in accordance with the pixel circuit at the normal display area 11, the transmittance of the transparent display area 12 may be low or even opaque, so that the components such as an optical detector and a camera fail to collect external light and images.

Therefore, based on the considerations of both transmittance and normal display, in the present disclosure, the display circuit 20 includes two differently structured pixel circuits, namely a first pixel circuit 21 and a second pixel circuit 22, wherein the first pixel circuit 21 is disposed at the normal display area 11, the second pixel circuit 22 is disposed at the transparent display area 12. When the first pixel circuit 21 and the second pixel circuit 22 are disposed, the transmittance of the transparent display area 12 should be ensured to be higher than that of the normal display area 11, so that not only the Screen-to-Body Ratio is effectively increased, but also the normal operation of the optical detector and the camera and the normal display function of the display screen will not be affected.

According to an embodiment of the present disclosure, the number of components of the second pixel circuit 22 is less than the number of components of the first pixel circuit 21.

Specifically, since the components such as the optical detector and the camera are disposed at the transparent display area 12, the area of the transparent display area 12 is relatively small (for example, a circle having a diameter of 5 mm), the picture uniformity has little influence on the picture quality. However, the area of the normal display area 11 is large, and therefore, the first pixel circuit 21 disposed at the normal display area 11 employs a conventional pixel circuit which can compensate for a threshold voltage $V_{th}$ or compensate for an IR drop to ensure picture display quality. The second pixel circuit 22 disposed at the transparent display area 12 may employ a basic pixel circuit to increase the transmittance as much as possible in the case of normal display. The second pixel circuit 22 can be less than the first pixel circuit 21 in terms of the number of components (such as TFT tubes), and can be less than the first pixel circuit 21 in terms of the number of lines, so as to reduce the occupied area of the second pixel circuit as much as possible, and improve the transmittance of the transparent display area.

Some examples of the first pixel circuit and the second pixel circuit in the present disclosure are given below.

Figure 2A:
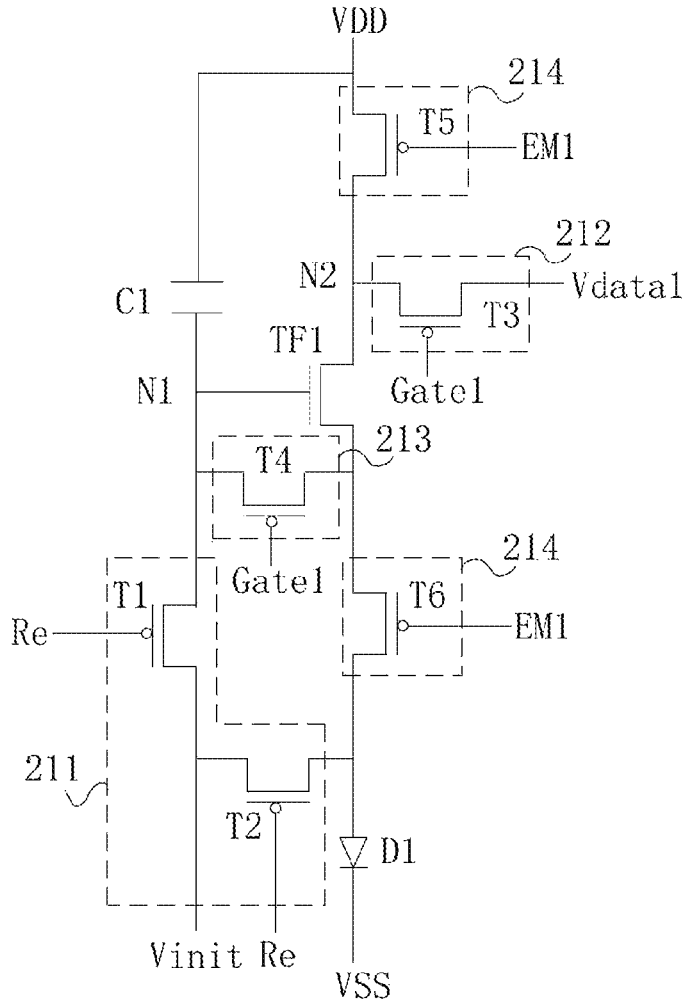
FIG. 2A is a schematic structural diagram of a first pixel circuit according to an embodiment of the present disclosure.

In one embodiment of the present disclosure, as shown in FIG. 2A, the first pixel circuit 21 includes a reset circuit 211, a first data writing circuit 212, a compensation circuit 213, and a first lighting control circuit 214. The reset circuit 211 is connected to a reset control line Re, a reset signal line Vinit, one end of a first storage capacitor C1, a control electrode of a first driving transistor TF1, and one end of a first lighting device D1 respectively. The reset circuit 211 is configured to reset one end of the first storage capacitor C1 and one end of the first lighting device D1. The first data writing circuit 212 is connected to a first data line Vdata1, a first gate line Gate1, and a first electrode of the first driving transistor TF1. The first data writing circuit 212 is configured to write a first data voltage to the first electrode of the first driving transistor TF1. The compensation circuit 213 is connected to the first gate line Gate1, the control electrode of the first driving transistor TF1, and a second electrode of the first driving transistor TF1 respectively. The compensation circuit 213 is configured to write the threshold voltage of the first driving transistor TF1 and the first data voltage to one end of the first storage capacitor C1. The first lighting control circuit 214 is connected to a first lighting control line EM1, a first power line VDD, a first electrode of the first driving transistor TF1, a second electrode of the first driving transistor TF1, and one end of the first lighting device D1 respectively, and the other end of the first lighting device D1 is connected to a second power line VSS. The light emission control circuit 214 is configured to write the first power voltage to the first electrode of the first driving transistor TF1, and control the first driving transistor TF1 driving the first lighting device D1 to emit light.

In the embodiment shown in FIG. 2A, the threshold voltage of the first driving transistor TF1 is extracted by the compensation circuit 213, and the threshold voltage of the first driving transistor TF1 can be cancelled during the driving of the first lighting device D1. Therefore, a non-uniformity caused by the threshold voltage of the first driving transistor and a ghost phenomenon caused by a threshold voltage drift can be effectively eliminated, and the display picture luminance unevenness caused by the difference of the threshold voltage of the first driving transistor in different pixel circuits can be avoided, thus ensuring the quality of the picture displayed in the normal display area.

Further, as shown in FIG. 2A, the reset circuit 211 may include a first transistor T1 and a second transistor T2. The control electrode of the first transistor T1 is connected to the reset control line Re, the first electrode of the first transistor T1 is connected to one end of the storage capacitor C1 and the control electrode of the first driving transistor TF1 respectively, and the second electrode of the first transistor T1 is connected to the reset signal line Vinit. The control electrode of the second transistor T2 is connected to the reset control line Re, the first electrode of the second transistor T2 is connected to the reset signal line Vinit, and the second electrode of the second transistor T2 is connected to one end of the first lighting device D1.

The first data writing circuit 212 may include a third transistor T3. The control electrode of the third transistor T3 is connected to the first gate line Gate1, the first electrode of the third transistor T3 is connected to the first data line Vdata1, and the second electrode of the third transistor T3 is connected to the first electrode of the first driving transistor TF1.

The compensation circuit 213 may include a fourth transistor T4. The control electrode of the fourth transistor T4 is connected to the first gate line Gate1, the first electrode of the fourth transistor T4 is connected to the control electrode of the first driving transistor TF1, and the second electrode of the fourth transistor T4 is connected to the second electrode of the first driving transistor TF1.

The first lighting control circuit 214 may include a fifth transistor T5 and a sixth transistor T6. The control electrode of the fifth transistor T5 is connected to the first lighting control line EM1, the first electrode of the fifth transistor T5 is connected to the first power line VDD, and the second electrode of the fifth transistor T5 is connected to the first electrode of the first driving transistor TF1. The control electrode of the sixth transistor T6 is connected to the first lighting control line EM1, the first electrode of the sixth transistor T6 is connected to the second electrode of the first driving transistor TF1, and the second electrode of the sixth transistor T6 is connected to one end of the first lighting device D1.

Figure 2B:
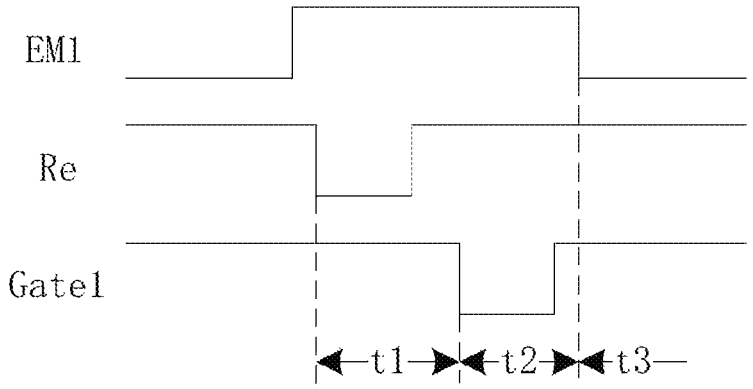
FIG. 2B is a control timing diagram of the first pixel circuit illustrated in FIG. 2A.

As shown in FIG. 2B, the operation process of the pixel circuit shown in FIG. 2A includes the following three stages:

The first stage t1 (reset stage): the signal of the reset control line Re is valid, and the first transistor T1 and the second transistor T2 are in an ON state so as to reset one end N1 of the first storage capacitor C1 and the anode of the first lighting device D1. At this time, the voltage $V_{init}$ of the reset signal line Vinit is written into the node N1, the voltage $V_{init}$ of the reset signal line Vinit is written into the anode of the first lighting device D1, and the first lighting device D1 keeps an OFF state.

The second stage t2 (data writing stage): the signal of the first gate line Gate1 is valid, and the third transistor T3 is in an ON state, at which time the first electrode of the first driving transistor TF1 is written a first data voltage $V_{data1}$, that is, the first data voltage $V_{data1}$ is written into the node N2; while the fourth transistor T4 is in an ON state, at which time the fourth transistor T4 writes the first data voltage $V_{data1}$ and the threshold voltage $V_{th1}$ of the first driving transistor TF1 into one end of the first storage capacitor C1. That is, $V_{data1}-V_{th1}$ is written into the node N1.

The third stage t3 (lighting stage): the signal of the first lighting control line EM1 is valid, the fifth transistor T5 and the sixth transistor T6 are in an ON state, and the potential of the node N2 is the voltage $V_{DD}$ provided by the first power line VDD, the potential of the node N1 is $V_{data1}-V_{th1}$, the voltage between the control electrode and the first electrode of the first driving transistor TF1 (ie, the gate-source voltage) $V_{gs}=V_{data1}-V_{th1}-VDD$, and the current flowing to the first lighting device D1 is $I=\frac{1}{2}\mu C_{ox}(W_1/L_1)(V_{gs}-V_{th1})^2=\frac{1}{2}\mu C_{ox}(W_1/L_1)(V_{data1}-V_{DD})^2$, where μ is a carrier mobility, $C_{ox}$ is a gate oxide capacitance, and $W_1/L_1$ is an aspect ratio of the first driving transistor TF1.

It can be seen from the formula of the current flowing to the first lighting device D1 that the current I is independent of the threshold voltage $V_{th1}$ of the first driving transistor TF1, thereby the display picture luminance unevenness caused by the difference of the threshold voltage of the first driving transistor in different pixel circuits can be avoided effectively, thus ensuring the quality of the picture displayed in the normal display area.

Therefore, by providing the above-described first pixel circuit at the normal display area of the display screen, the quality of the picture displayed can be ensured. In addition, it should be noted that FIG. 2A only schematically illustrates the structure of the first pixel circuit, and is not a limitation to the structure of the pixel circuit. Other layout manners may be adopted in actual design. For example, the pixel circuit structure shown as FIG. 2C may be adopted.

Figure 2C:
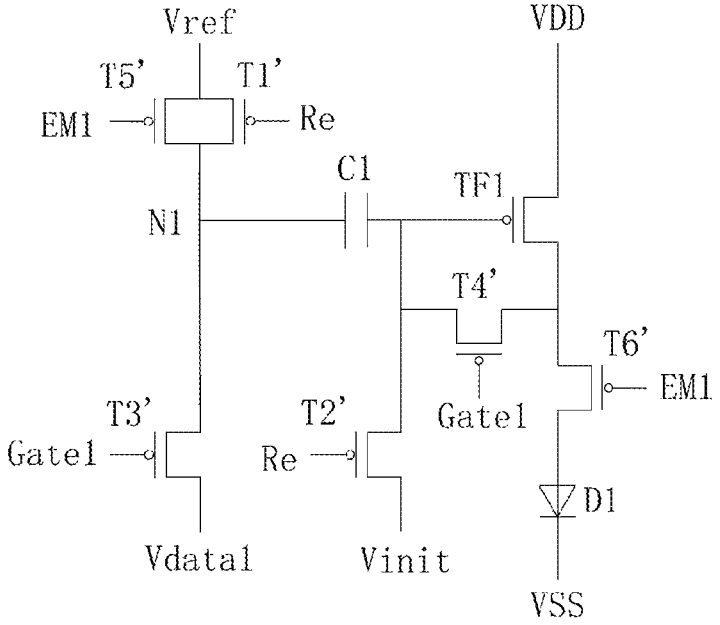
FIG. 2C is a schematic structural diagram of a first pixel circuit according to another embodiment of the present disclosure.

In the pixel circuit structure shown in FIG. 2C, a non-uniformity caused by the threshold voltage of the first driving transistor TF1 and a ghost phenomenon caused by a threshold voltage drift can be effectively eliminated, and the display picture luminance unevenness caused by the difference of the threshold voltage of the first driving transistor in different pixel circuits can be avoided, thus ensuring the quality of the picture displayed in the normal display area. At the same time, the lighting control circuit writes a reference voltage to one end N1 of the first storage capacitor C1, and the reference voltage is transmitted through a reference signal line Vref independent of the first power supply line VDD. In the driving process, the current on the reference signal line Vref is relatively small, the voltage drop is relatively small, and the reference voltage provided by the reference signal line Vref is more stable than the voltage provided by the first power line VDD, so the gate voltage of the first driving transistor TF1 is more stable. Therefore, it is possible to avoid the problem that the voltage drop provided by the first power line VDD affects the current and causes uneven luminance of different pixel circuits. It should be noted that the working principle of the pixel circuit shown in FIG. 2C is similar to the working process of the pixel circuit shown in FIG. 2A, and will not be described in detail herein.

Figure 3A:
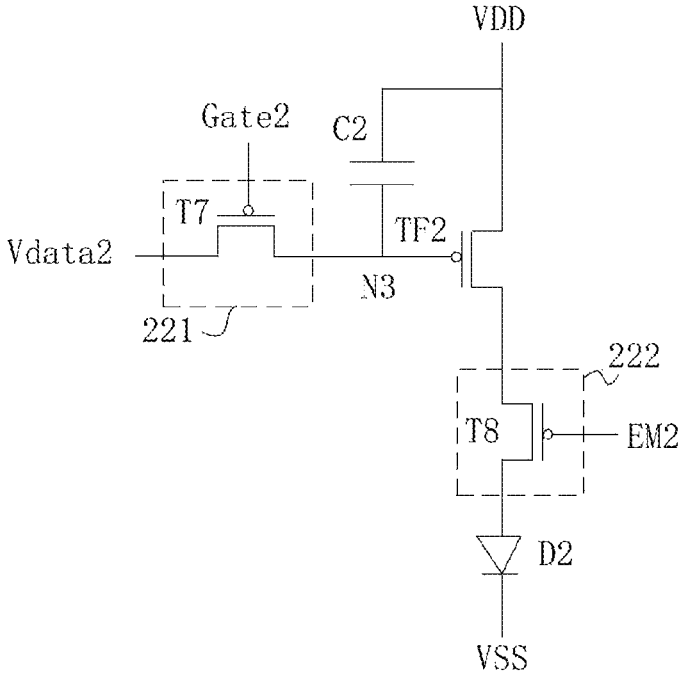
FIG. 3A is a schematic structural diagram of a second pixel circuit according to an embodiment of the present disclosure.

In an embodiment of the present disclosure, as shown in FIG. 3A, the second pixel circuit 22 may include: a second data writing circuit 221 and a second lighting control circuit 222. The second data writing circuit 221 is connected to the second data line Vdata2, the second gate line Gate2, one end of the second storage capacitor C2 and the control electrode of the second driving transistor TF2 respectively. The other end of the second storage capacitor C2 and the first electrode of the second driving transistor TF2 are respectively connected to the first power line VDD. The second data writing circuit 221 is configured to write a second data voltage to one end of the second storage capacitor C2. The second lighting control circuit 222 is connected to the second lighting control line EM2, the second electrode of the second driving transistor TF2 and one end of the second lighting device D2 respectively. The other end of the second lighting device D2 is connected to the second power line VSS. The second lighting control circuit 222 is configured to control the second driving transistor TF2 to drive the second lighting device D2 to light.

In the pixel circuit shown in FIG. 3A, the reset circuit and the compensation circuit are omitted, and only the data writing circuit and the lighting control circuit are retained. Since the reset circuit and the compensation circuit are omitted, the layout area is greatly reduced as compared with the above pixel circuit having the compensation capability. Under a reasonable design, the layout area can be reduced by more than 40%, so that the transmittance of the transparent display area can be greatly improved. Moreover, as can be seen from the foregoing analysis, since the area of the transparent display area is small, even if the second pixel circuit provides only the most basic display function, the uniformity of the entire picture display will not be affected.

Further, as shown in FIG. 3A, the second data writing circuit 221 may include a seventh transistor T7. The control electrode of the seventh transistor T7 is connected to the second gate line Gate2, the first electrode of the seventh transistor T7 is connected to the second data line Vdata2, and the second electrode of the seventh transistor T7 is connected to one end of the second storage capacitor C2 and the control electrode of the second driving transistor TF2 respectively.

The second lighting control circuit 222 may include an eighth transistor T8. The control electrode of the eighth transistor T8 is connected to the second lighting control line EM2, the first electrode of the eighth transistor EM2 is connected to the second electrode of the second driving transistor TF2, and the second electrode of the eight transistor T8 is connected to one end of the second lighting device D2.

Figure 3B:
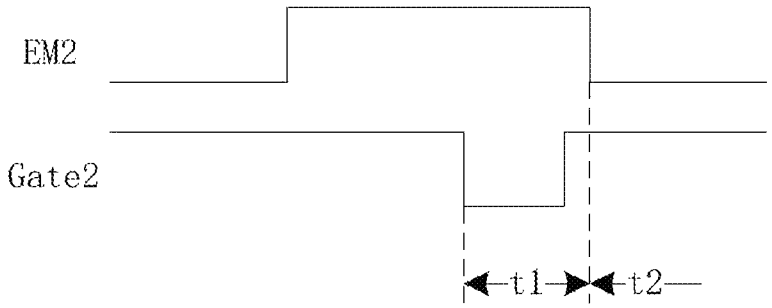
FIG. 3B is a control timing diagram of the second pixel circuit illustrated in FIG. 3A; FIG.

As shown in FIG. 3B, the working process of the pixel circuit shown in FIG. 3A includes the following two stages:

The first stage t1 (data writing stage): the signal of the second gate line Gate2 is valid, and the seventh transistor T7 is in ON state. At this time, one end N3 of the second storage capacitor C2 is written into the second data voltage $V_{data2}$. That is, the second data voltage $V_{data2}$ is written into the node N3 while the second driving transistor TF2 is in ON state.

The second stage t2 (lighting stage): the signal of the second lighting control line EM2 is valid, and the eighth transistor T8 is in ON state, and the current flowing to the second lighting device D2 is $I=\frac{1}{2}\mu C_{ox}(W_2/L_2)(V_{gs}-V_{th})^2=\frac{1}{2}\mu C_{ox}(W_2/L_2)(V_{data2}-V_{DD}-V_{th2})^2$, where $V_{th2}$ is the threshold voltage of the second driving transistor TF2, μ is the carrier mobility, $C_{ox}$ is the gate oxide capacitance, $W_2/L_2$ is the aspect ratio of the second driving transistor TF2.

By comparing the pixel circuit shown in FIG. 2A (or FIG. 2C) with that shown in FIG. 3A, the number of components of the second pixel circuit 22 shown in FIG. 3A is significantly smaller than that of the pixel circuit shown in FIG. 2A (or FIG. 2C). Since the number of components is reduced, the area of the layout of the second pixel circuit 22 is significantly reduced in a case that the area occupied by the original single pixel circuit is constant, so that the transmittance of the corresponding transparent display area 12 is greatly improved. Further, the number of signal lines is reduced while the components are reduced, thereby providing greater transmittance. Thus, the components such as optical sensors or cameras can be secured to collect light or the image when these components such as optical sensors or cameras are disposed behind the display screen. Meantime, since the components such as optical sensors or cameras are disposed behind the display screen, the position in the front of the display screen is not occupied, so that the Screen-to-Body Ratio of the display screen is significantly improved.

It should be noted that, in the embodiments of the present disclosure, the transmittance of the transparent display area can be improved not only by reducing the number of components in the pixel circuit but also by adopting other methods.

In an embodiment of the present disclosure, the pixel aperture ratio of the transparent display area 12 is greater than the pixel aperture ratio of the normal display area 11. Here, the pixel aperture ratio refers to a ratio between the area of the light passing part after removing the wiring portion and the transistor portion of each pixel and the area of each pixel as a whole. The higher the aperture ratio is, the higher the efficiency of light passage is. In short, the transmittance is increased by reducing the lighting area of the transparent display area 12.

According to the meaning of the pixel aperture ratio, it is known that the transmittance of the transparent display area is improved by reducing the number of components in the pixel circuit, and the essence can also be understood as increasing the transmittance of the transparent display area by increasing the pixel aperture ratio thereof. Of course, in the actual design, not only can this method be adopted, but also an organic transparent dielectric material can be used as the medium of the storage capacitor in the pixel circuit, so that the pixel electrode has a larger overlap with the gate line and the data line, so that the pixel aperture ratio can be increased by 10% or more, thereby increasing the transmittance by 20% or more.

In another embodiment of the present disclosure, PPI of the transparent display area 12 is smaller than PPI of the normal display area 11, wherein the PPI refers to the number of pixels included in the image per inch distance.

Figure 4:
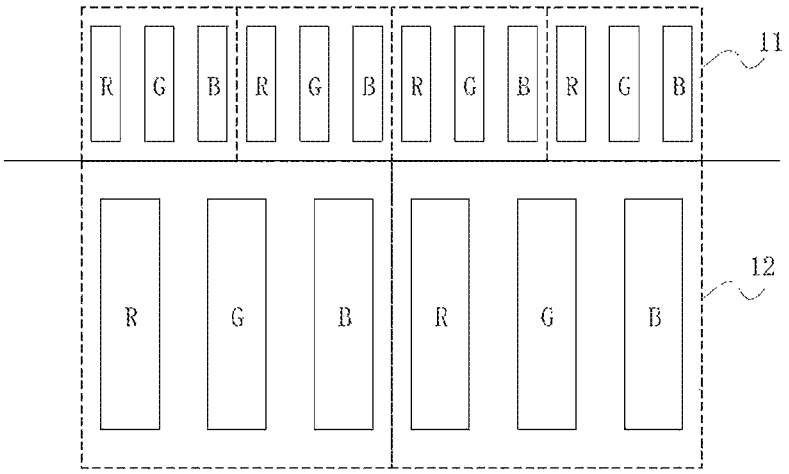
FIG. 4 is a schematic diagram of a transparent display area and a normal display area having different PPIs according to an embodiment of the present disclosure.

Specifically, the pixel aperture ratio of the transparent display area 12 may be set to be the same as the pixel aperture ratio of the normal display area 11. However, the PPI of the transparent display area 12 is smaller than the PPI of the normal display area 11. That is, the number of pixels included the image per inch distance in the transparent display area 12 is smaller than the number of pixels included in the image per inch of distance in the normal display area 11. As shown in FIG. 4, the PPI of the transparent display area 12 is reduced by ½, and the number of corresponding pixel circuits is reduced by ¾, so that the area occupied by the layout is greatly reduced, thereby effectively improving the transmittance of the transparent display area. Therefore, it is also possible to effectively increase the transmittance of the transparent display area by adopting a method of lowering PPI.

Therefore, it can be seen from the foregoing analysis that there are various ways to increase the transmittance of the transparent display area, and the specific method may be determined according to actual needs, which is not limited herein. However, it should be noted that when different pixel circuits are used to increase the transmittance of the transparent display area, since the transparent display area sacrifices threshold voltage compensation and IR Drop compensation, etc., under the influence of the threshold voltage, the luminance of the transparent display area will be reduced. Thus, the luminance compensation is also required for the transparent display area, so that the entire picture can be displayed almost without error, which improves the user experience.

Specifically, by analyzing the working principle of the pixel circuit shown in FIG. 2A and FIG. 3A, in the first pixel circuit 21 shown in FIG. 2A, the current flowing to the first lighting device D1 is $I=\frac{1}{2}\mu C_{ox}(W_1/L_1)(V_{gs}-V_{th1})^2=\frac{1}{2}\mu C_{ox}(W_1/L_1)(V_{data1}-V_{DD})^2$; and in the second pixel circuit 22 shown in FIG. 3A, the current flowing to the second lighting device D2 is $I=\frac{1}{2}\mu C_{ox}(W_2/L_2)(V_{gs}-V_{th})^2=\frac{1}{2}\mu C_{ox}(W_2/L_2)(V_{data2}-V_{DD}-V_{th2})^2$. Wherein, if the first pixel circuit 21 and the second pixel circuit 22 adopt the same data voltage, that is, the first data voltage $V_{data1}$ is the same as the second data voltage $V_{data2}$, the current flowing to the first lighting device D1 will be different from that flowing to the second lighting device D2, resulting in the luminance of the transparent display area 12 being different from the luminance of the normal display area 11. Therefore, the luminance of the transparent display area 12 needs to be compensated. Considering that the transparent display area 12 is limited by the transmittance, it is not possible to increase the display luminance by adding a component, and by comparing the two currents, it is possible to use the different data voltages to control the first pixel circuit 11 and the second pixel circuit 12 so as to realize luminance compensation by software.

Figure 5:
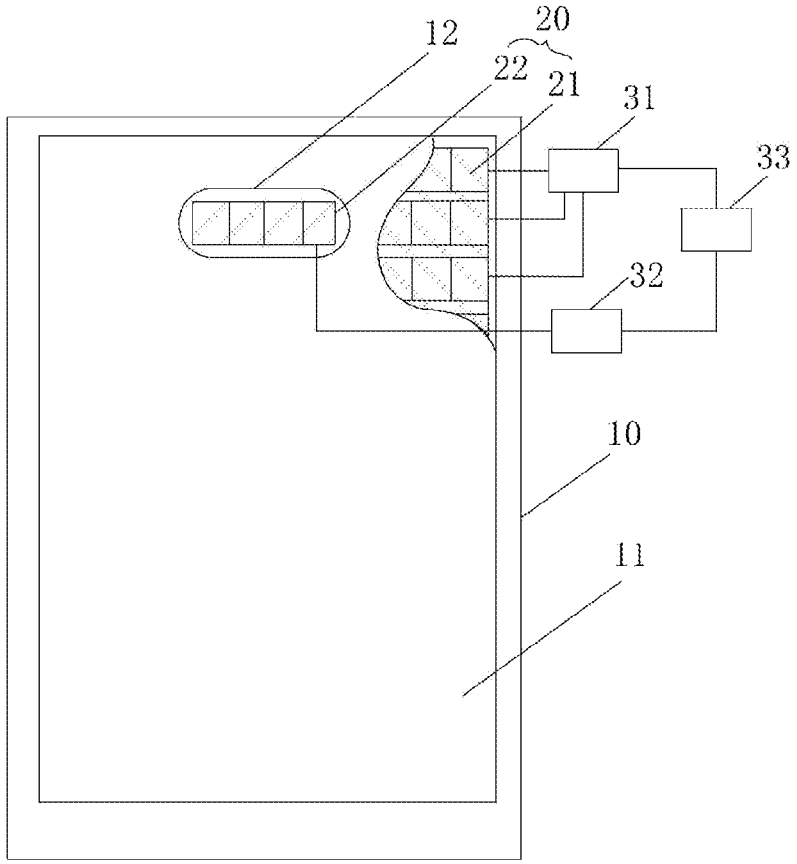
FIG. 5 is a schematic block diagram of a display circuit for a display screen in accordance with another embodiment of the present disclosure.

According to an embodiment of the present disclosure, as shown in FIG. 5, the above display circuit 10 for a display screen may further include: a first luminance adjustment circuit 31 and a second luminance adjustment circuit 32. The first luminance adjustment circuit 31 is connected to the first pixel circuit 21, and the first luminance adjustment circuit 31 is configured to output a first data voltage to the first pixel circuit 21 to adjust the luminance of the normal display area 11; and the second luminance adjustment circuit 32 is connected to the second pixel circuit 22, and the second luminance adjustment circuit 32 is configured to output a second data voltage to the second pixel circuit 22 to adjust the luminance of the transparent display area 12.

Further, as shown in FIG. 5, the display circuit 10 for a display screen further includes a luminance compensation circuit 33. The luminance compensation circuit 33 is connected to the first luminance adjustment circuit 31 and the second luminance adjustment circuit 32, respectively, and the luminance compensation circuit 33 is configured to acquire the second data voltage according to the first data voltage and the threshold voltage of the second driving transistor TF2 in the second pixel circuit 22, such that the luminance of the transparent display area 12 is the same as the luminance of the normal display area 11.

That is, the second data voltage of the transparent display area 12 and the first data voltage of the normal display area 11 are input respectively, so that the luminance of the two areas can be independently adjusted. The luminance of the transparent display area 12 is compensated by the compensation circuit 33, so that the luminance of the transparent display area can be raised to the luminance level of the normal display area. It can be known from the formula of the current flowing to the first lighting device D1 and the formula of the current flowing to the second lighting device D2 that, the two currents are different by a threshold voltage, and therefore, the second data voltage of the transparent display area 12 can be adjusted to be the sum of the first data voltage of the normal display area 11 and the threshold voltage of the second driving transistor TF2 in the second pixel circuit 22. That is, the second data voltage $V_{data2}$=the first data voltage $V_{data1}$+the threshold voltage $V_{th2}$ of the second driving transistor TF2, thereby the luminance of the transparent display area can be raised to the luminance level of the normal display area.

It should be noted that the structure of the display screen shown in FIG. 5 is only a schematic description, and is not a specific limitation to the structure. In actual design, the first luminance adjustment circuit 31, the second luminance adjustment circuit 32, and the luminance compensation circuit 33 can be integrated set in the GOA circuit of the display screen. Further, it can be set in the IC chip in the GOA circuit, and can be set according to actual needs.

According to another embodiment of the present disclosure, the aspect ratio of the first driving transistor TF1 in the first pixel circuit 21 is greater than the aspect ratio of the second driving transistor TF2 in the second pixel circuit 22, so that the luminance of the transparent display area 12 is the same as the luminance of the normal display area 11.

That is to say, in the present disclosure, not only the different data voltages can be input to achieve the purpose of luminance compensation of the transparent display area, but also the luminance compensation can be performed by a hardware structure. For example, the pixel current can be changed by changing the aspect ratio $W_2/L_2$ of the second driving transistor TF2 in the transparent display area 12, thereby achieving the effect of improving the luminance of the transparent display area. The specific method to be adopted can be selected according to actual conditions, which is no limited here.

In summary, according to the display circuit for a display screen of the embodiment of the present disclosure, by disposing a normal display area and a transparent display area on the display screen, and by disposing a pixel circuit at the transparent display area different from that at the normal display area, transmittance of the transparent display area is effectively improved. So, an optical detector and a camera can be disposed at the transparent display area, thereby effectively increasing the Screen-to-Body Ratio without affecting the normal operation of the optical detector and the camera and the normal display function of the display screen. Moreover, while improving the transmittance of the transparent display area, the transparent display area is also subjected to luminance compensation, so that the display screen has a higher picture display quality, and the user has a better use experience.

The display screen of the embodiment of the present disclosure will be described in detail below.

As shown in FIGS. 1 and 5, the display screen 10 of the embodiment of the present disclosure includes a normal display area 11, a transparent display area 12, and the display circuit 20 described above.

It should be noted that, for details not disclosed in the display screen 10 of the embodiment of the present disclosure, reference may be made to the details disclosed in the display circuit for the display screen of the embodiment of the present disclosure, and details will not be described herein again.

According to the display screen of the embodiment of the present disclosure, by adopting the display circuit described above, transmittance of the transparent display area is effectively improved by disposing a pixel circuit at the transparent display area of the display screen different from that at the normal display area of the display screen, and an optical detector and a camera can be disposed at the transparent display area, thereby effectively increasing the Screen-to-Body Ratio without affecting the normal operation of the optical detector and the camera and the normal display function of the display screen. Moreover, while improving the transmittance of the transparent display area, the transparent display area is also subjected to luminance compensation, so that the display screen has a higher picture display quality, and the user has a better use experience.

The display device of the embodiment of the present disclosure will be described in detail below.

The display device of the embodiment of the present disclosure includes the display screen 10 described above. The display device may be: an OLED panel, a mobile phone, a tablet computer, a television, a display, a notebook computer, a digital photo frame, a navigator, and the like, or any product or component having a display function.

According to the display device of the embodiment of the present disclosure, by adopting the display circuit described above, transmittance of the transparent display area is effectively improved by disposing a pixel circuit at the transparent display area of the display screen different from that at the normal display area of the display screen, and an optical detector and a camera can be disposed at the transparent display area, thereby effectively increasing the Screen-to-Body Ratio without affecting the normal operation of the optical detector and the camera and the normal display function of the display screen. Moreover, while improving the transmittance of the transparent display area, the transparent display area is also subjected to luminance compensation, so that the display screen has a higher picture display quality, and the user has a better use experience.

A method of luminance compensation for a display circuit for a display screen of an embodiment of the present disclosure will be described in detail below.

Figure 6:
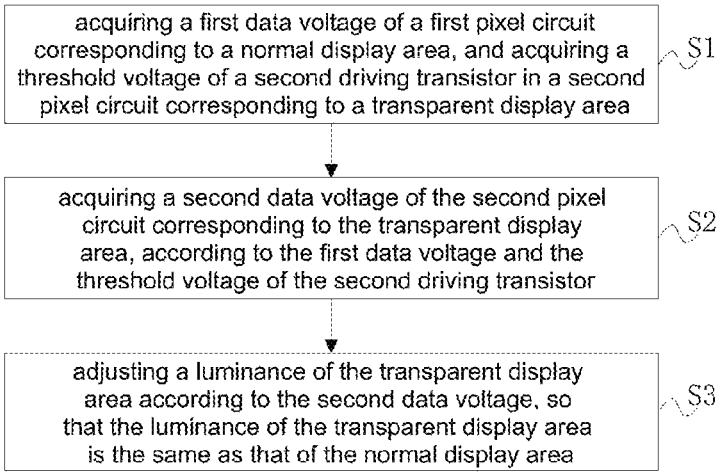
FIG. 6 is a flowchart of a luminance compensation method for a display circuit for a display screen according to an embodiment of the present disclosure.

FIG. 6 is a flowchart of a luminance compensation method for a display circuit for a display screen according to an embodiment of the present disclosure. Among them, the display circuit for the display screen has been described in detail above, and will not be described here.

As shown in FIG. 6, the luminance compensation method for the display circuit of the display screen may include the following steps:

S1. Acquire a first data voltage of the first pixel circuit corresponding to the normal display area, and acquire a threshold voltage of the second driving transistor in the second pixel circuit corresponding to the transparent display area.

S2. Acquire a second data voltage of the second pixel circuit corresponding to the transparent display area according to the first data voltage and the threshold voltage of the second driving transistor.

S3. Adjust the luminance of the transparent display area according to the second data voltage, so that the luminance of the transparent display area is the same as the luminance of the normal display area.

Specifically, by analyzing the working principle of the pixel circuit shown in FIG. 2A and FIG. 3A, in the first pixel circuit shown in FIG. 2A, the current flowing to the first lighting device is $I=\frac{1}{2}\mu C_{ox}(W_1/L_1)(V_{gs}-V_{th1})^2=\frac{1}{2}\mu C_{ox}(W_1/L_1)(V_{data1}-V_{DD})^2$; and in the second pixel circuit shown in FIG. 3A, the current flowing to the second lighting device is $I=\frac{1}{2}\mu C_{ox}(W_2/L_2)(V_{gs}-V_{th})^2=\frac{1}{2}\mu C_{ox}(W_2/L_2)(V_{data2}-V_{DD}-V_{th2})^2$. Wherein, if the first pixel circuit and the second pixel circuit adopt the same data voltage, that is, the first data voltage $V_{data1}$ is the same as the second data voltage $V_{data2}$, the current flowing to the first lighting device will be different from that flowing to the second lighting device, resulting in the luminance of the transparent display area being different from the luminance of the normal display area. Therefore, the luminance of the transparent display area needs to be compensated. Considering that the transparent display area is limited by the transmittance, it is not possible to increase the display luminance by adding a component, and by comparing the two currents, it is possible to use the different data voltages to control the first pixel circuit and the second pixel circuit so as to realize luminance compensation by software.

Specifically, it can be known from the formula of the current flowing to the first lighting device and the formula of the current flowing to the second lighting device that, the two currents are different by a threshold voltage, and therefore, the second data voltage of the transparent display area can be adjusted to be the sum of the first data voltage of the normal display area land the threshold voltage of the second driving transistor in the second pixel circuit. That is, the second data voltage $V_{data2}$=the first data voltage $V_{data1}$+the threshold voltage $V_{th2}$ of the second driving transistor TF2, thereby the luminance of the transparent display area can be raised to the luminance level of the normal display area.

According to the luminance compensation method for the display circuit of the display screen of the embodiment of the present disclosure, the first data voltage of the first pixel circuit corresponding to the normal display area is acquired, the threshold voltage of the second driving transistor of the second pixel circuit corresponding to the transparent display area is acquired, a second data voltage of the second pixel circuit corresponding to the transparent display area is acquired according to the first data voltage and the threshold voltage of the second driving transistor, and the luminance of the transparent display area is adjusted according to the second data voltage, so that the luminance of the transparent display area is the same as the luminance of the normal display area. Thereby, the luminance compensation is implemented by performing voltage compensation on the basis of the data voltage corresponding to the first pixel circuit, so that the luminance of the transparent display area is the same as the luminance of the normal display area. By doing so, the problems of the luminance reduction due to transmittance increasing of the transparent display area and the picture quality difference between the transparent display area and the normal display area led correspondingly can be effectively reduced. Further, the method is simple, reliable, easy to implement, and highly versatile.

In the description of the present disclosure, it is to be understood that the orientation or positional relationship indicated by the terms "center", "longitudinal", "horizontal", "length", "width", "thickness", "upper", "lower", "front", "behind", "left", "right", "vertical", "horizontal", "top", "bottom", "inside", "outside", "clockwise", "counterclockwise", "axial", "radial", "circumferential" and the like is based on the orientation or positional relationship shown in the drawings, which is merely for the convenience of describing the present disclosure and simplifying the description, and does not indicate or imply the device or component should have a particular orientation or should be constructed and operated in a particular orientation, and thus should not be construed as a limitation to the disclosure.

Moreover, the terms "first" and "second" are used for descriptive purposes only and are not to be construed as indicating or implying a relative importance or implicitly indicating the number of technical features indicated. Thus, features defined with "first" or "second" may include at least one of the features, either explicitly or implicitly. In the description of the present disclosure, the meaning of "a plurality" is at least two, such as two, three, etc., unless specifically defined otherwise.

In the present disclosure, unless explicitly stated or defined otherwise, the terms "installation", "connected", "connected", "fixed", and the like, are to be understood broadly, and may be a fixed connection, or a detachable connection, or integrated; may be mechanical or electrical connection; may be directly connected, or indirectly connected through an intermediate medium, may be the internal communication of two elements or the interaction of two elements, unless explicitly defined otherwise. The specific meanings of the above terms in the present disclosure can be understood by those skilled in the art on a case-by-case basis.

In the present disclosure, the first feature "on" or "under" the second feature may be a direct contact of the first and second features, or the first and second features may be contact indirectly through an intermediate medium, unless otherwise explicitly stated and defined. Moreover, the first feature "above", "on" and "upward" the second feature may be that the first feature is directly above or obliquely above the second feature, or merely that the level of the first feature is higher than that of the second feature. The first feature "below", "beneath" and "under" the second feature may be that the first feature is directly below or obliquely below the second feature, or merely that the level of the first feature is less than that of the second feature.

In the description of the present specification, the description with reference to the terms "one embodiment", "some embodiments", "example", "specific example", or "some examples" and the like means a specific feature, structure, material, or characteristic described in connection with the embodiment or the example is included in at least one embodiment or example of the present disclosure. In the present specification, the schematic representation of the above terms is not necessarily directed to the same embodiment or example. Furthermore, the specific feature, structure, material, or characteristic described may be combined in a suitable manner in any one or more embodiments or examples. In addition, various embodiments or examples described in the specification, as well as features of various embodiments or examples, may be incorporated and combined without contradiction.

While the embodiments of the present disclosure have been shown and described above, it can be understood that the foregoing embodiments are illustrative and are not to be construed as limiting the scope of the disclosure. Those skilled in the art may make changes, modifications, substitutions and variations to the above embodiments which fall into the scope of the present disclosure.

The present disclosure claims priority to Chinese Patent Application No. 201711270046.5, filed on Dec. 5, 2017, which is incorporated by reference herein in its entirety as part of the present application.

What is claimed is:

1. A display circuit for a display screen, the display screen comprising a first area and a second area, the display circuit comprising:

a first pixel circuit which is disposed at the first area; and a second pixel circuit which is disposed at the second area;

wherein the structure of the first pixel circuit is different from that of the second pixel circuit, so that the transmittance of the second area is higher than the transmittance of the first area, wherein the first pixel circuit comprises:

a reset circuit, which is connected to a reset control line, a reset signal line, one end of a first storage capacitor, a control electrode of a first driving transistor, and one end of a first lighting device respectively, and is configured to reset said one end of the first storage capacitor and said one end of the first lighting device;

a first data writing circuit, which is connected to a first data line, a first gate line and a first electrode of the first driving transistor respectively, and is configured to write a first data voltage into the first electrode of the first driving transistor;

a compensation circuit, which is connected to a first gate line, the control electrode of the first driving transistor, and a second electrode of the first driving transistor respectively, and is configured to write the threshold voltage of the first driving transistor and the first data voltage into said one end of the first storage capacitor;

a first lighting control circuit, which is connected to a first lighting control line, a first power line, the first electrode of the first driving transistor, a second electrode of the first driving transistor, said one end of the first lighting device respectively, the other end of the first lighting device is connected to a second power line, and the lighting control circuit is configured to write a first power voltage into the first electrode of the first driving transistor, and control the first driving transistor to drive the first lighting device to emit light.

2. The display circuit for a display screen according to claim 1, wherein the number of components of the second pixel circuit is less than the number of components of the first pixel circuit.

3. The display circuit for a display screen according to claim 1, wherein the reset circuit comprises:

a first transistor, a control electrode of the first transistor is connected to a reset control line, a first electrode of the first transistor is connected to one end of the first storage capacitor and a control electrode of the first driving transistor respectively, the second electrode of the first transistor is connected to the reset signal line; and a second transistor, a control electrode of the second transistor is connected to the reset control line, a first electrode of the second transistor is connected to the reset signal line, and a second electrode of the second transistor is connected to one end of a first lighting device.

4. The display circuit for a display screen according to claim 1, wherein the first data writing circuit comprises:

a third transistor, a control electrode of the third transistor is connected to the first gate line, a first electrode of the third transistor is connected to the first data line, and a second electrode of the third transistor is connected to the first electrode of the first drive transistor.

5. The display circuit for a display screen according to claim 1, wherein the compensation circuit comprises:

a fourth transistor, a control electrode of the fourth transistor is connected to the first gate line, a first electrode of the fourth transistor is connected to a control electrode of the first driving transistor, and a second electrode of the fourth transistor is connected to a second electrode of the first driving transistor.

6. The display circuit for a display screen according to claim 1, wherein the first lighting control circuit comprises:

a fifth transistor, a control electrode of the fifth transistor is connected to the first lighting control line, a first electrode of the fifth transistor is connected to the first power line, and a second electrode of the fifth transistor is connected to a first electrode of the first driving transistor;

a sixth transistor, a control electrode of the sixth transistor is connected to the first lighting control line, a first electrode of the sixth transistor is connected to a second electrode of the first driving transistor, and a second electrode of the sixth transistor is connected to one end of the first lighting device.

7. The display circuit for a display screen according to claim 1, wherein the second pixel circuit comprises:

a second data writing circuit, which is connected to the second data line, the second gate line, one end of the second storage capacitor, and the control electrode of the second driving transistor respectively, the other end of the second storage capacitor and the first electrode of the second driving transistor are respectively connected to the first power line, and the second data writing circuit is configured to write the second data voltage to one end of the second storage capacitor;

a second lighting control circuit, which is connected to the second lighting control line, the second electrode of the second driving transistor, and one end of the second lighting device respectively, the other end of the second lighting device is connected to the second power line, and the second lighting control circuit is configured to control the second driving transistor to drive the second lighting device to emit light.

8. The display circuit for a display screen according to claim 7, wherein the second data writing circuit comprises:

a seventh transistor, a control electrode of the seventh transistor is connected to the second gate line, a first electrode of the seventh transistor is connected to the second data line, and a second electrode of the seventh transistor is one end of the second storage capacitor and a control electrode of the second driving transistor respectively.

9. The display circuit for a display screen according to claim 7, wherein the second lighting control circuit comprises:

an eighth transistor, a control electrode of the eighth transistor is connected to the second lighting control line, a first electrode of the eighth transistor is connected to a second electrode of the second driving transistor, and a second electrode of the eighth transistor is connected to one end of the second lighting device.

10. The display circuit for a display screen of claim 1, wherein a PPI of the second area is smaller than a PPI of the first area.

11. The display circuit for a display screen according to claim 1, wherein a pixel aperture ratio of the second area is greater than a pixel aperture ratio of the first area.

12. The display circuit for a display screen according to claim 1, further comprising:

a first luminance adjustment circuit, which is connected to the first pixel circuit, and is configured to output a first data voltage to the first pixel circuit to adjust the luminance of the first area;

a second luminance adjustment circuit, which is connected to the second pixel circuit, and is configured to output a second data voltage to the second pixel circuit to adjust the luminance of the second area.

13. The display circuit for a display screen according to claim 1, further comprising:

a luminance compensation circuit, which is connected to the first luminance adjustment circuit and the second luminance adjustment circuit respectively, and is configured to acquire the second data voltage according to the first data voltage and the threshold voltage of the second driving transistor in the second pixel circuit such that the luminance of the second area is the same as the luminance of the first area.

14. The display circuit for a display screen according to claim 1.

15. The display circuit for a display screen of claim 1, wherein the second area is disposed at an edge portion in the first area.

16. A display screen comprising a first area, a second area, and a display circuit as claimed in claim 1.

17. A display device comprising the display screen of claim 16.

18. A method of luminance compensation for a display circuit for a display screen according to claim 1, comprising the steps of:

acquiring a first data voltage of the first pixel circuit disposed at the first area, and acquiring a second threshold voltage of the second driving transistor in the second pixel circuit disposed at the second area;

acquiring a second data voltage of the second pixel circuit disposed at the second area, according to the first data voltage and the threshold voltage of the second driving transistor;

adjusting the luminance of the second area according to the second data voltage, such that the luminance of the second area is the same as the luminance of the first area.

19. The display circuit for a display screen according to claim 7, wherein an aspect ratio of the first driving transistor in the first pixel circuit is greater than that of the second driving transistor in the second pixel circuit, such that the luminance of the second area is the same as the luminance of the first area.

* * * * *